US006629552B1

(12) United States Patent
Herrmannsen et al.

(10) Patent No.: US 6,629,552 B1
(45) Date of Patent: Oct. 7, 2003

(54) DEVICE FOR TRANSFERRING A MATERIAL IN THE FORM OF A FILM THAT IS APPLIED TO A CARRIER STRIP ONTO A SUBSTRATE

(75) Inventors: Wulf Herrmannsen, Ronnenberg (DE); Wolfgang Bauersachs, Wedemark (DE); Christoph Manusch, Hemmingen (DE); Hartmut Rudolf, Hannover (DE)

(73) Assignee: Pritt Produktionsgesellschft mbH (DE)

( * ) Notice: Subject to any disclaimer, the term of this patent is extended or adjusted under 35 U.S.C. 154(b) by 0 days.

(21) Appl. No.: 09/806,596

(22) PCT Filed: Aug. 10, 1999

(86) PCT No.: PCT/EP99/05786

§ 371 (c)(1),
(2), (4) Date: Mar. 28, 2001

(87) PCT Pub. No.: WO00/10897

PCT Pub. Date: Mar. 2, 2000

(30) Foreign Application Priority Data

Aug. 19, 1998 (DE) ..... 198 37 573
Dec. 22, 1998 (DE) ..... 198 59 270

(51) Int. Cl.[7] ..... B32B 31/00

(52) U.S. Cl. ..... 156/577; 156/523; 156/579; 118/76; 242/160.4; 242/171; 242/588.6; 206/411

(58) Field of Search ..... 156/523, 527, 156/538, 540, 574, 577, 579; 118/76, 200, 257; 225/46; 242/160.2, 160.4, 170, 171, 588, 588.2, 588.3, 588.6

(56) References Cited

U.S. PATENT DOCUMENTS

| | | | | | |
|---|---|---|---|---|---|
| 4,853,074 | A | * | 8/1989 | Manusch et al. | 156/577 |
| 5,303,759 | A | * | 4/1994 | Czech | 156/523 |
| 5,430,904 | A | * | 7/1995 | Ono et al. | 118/257 |
| 5,714,035 | A | * | 2/1998 | Stevens | 156/540 |
| 6,435,248 | B1 | * | 8/2002 | Masumoto | 118/257 |

FOREIGN PATENT DOCUMENTS

| | | |
|---|---|---|
| EP | 0 427 870 | 11/1990 |

* cited by examiner

*Primary Examiner*—Mark A. Osele
(74) *Attorney, Agent, or Firm*—Connolly Bove Lodge & Hutz LLP

(57) ABSTRACT

A device for transferring a film from a carrier strip onto a substrate includes a housing having a supply reel and an empty reel. A film coated carrier strip is guided over an applicator foot where a clip-type slide element is provided in the region around which the carrier strip is looped. The clip-type slide element is made of a friction-reducing material secured to the applicator foot. The slide element has an elliptical cross-sectional shape so that on transfer of the film onto the substrate the contact pressure region of the slide element bears over an area adjacent to the substrate with interposition of the carrier strip.

7 Claims, 4 Drawing Sheets

Figure 1:
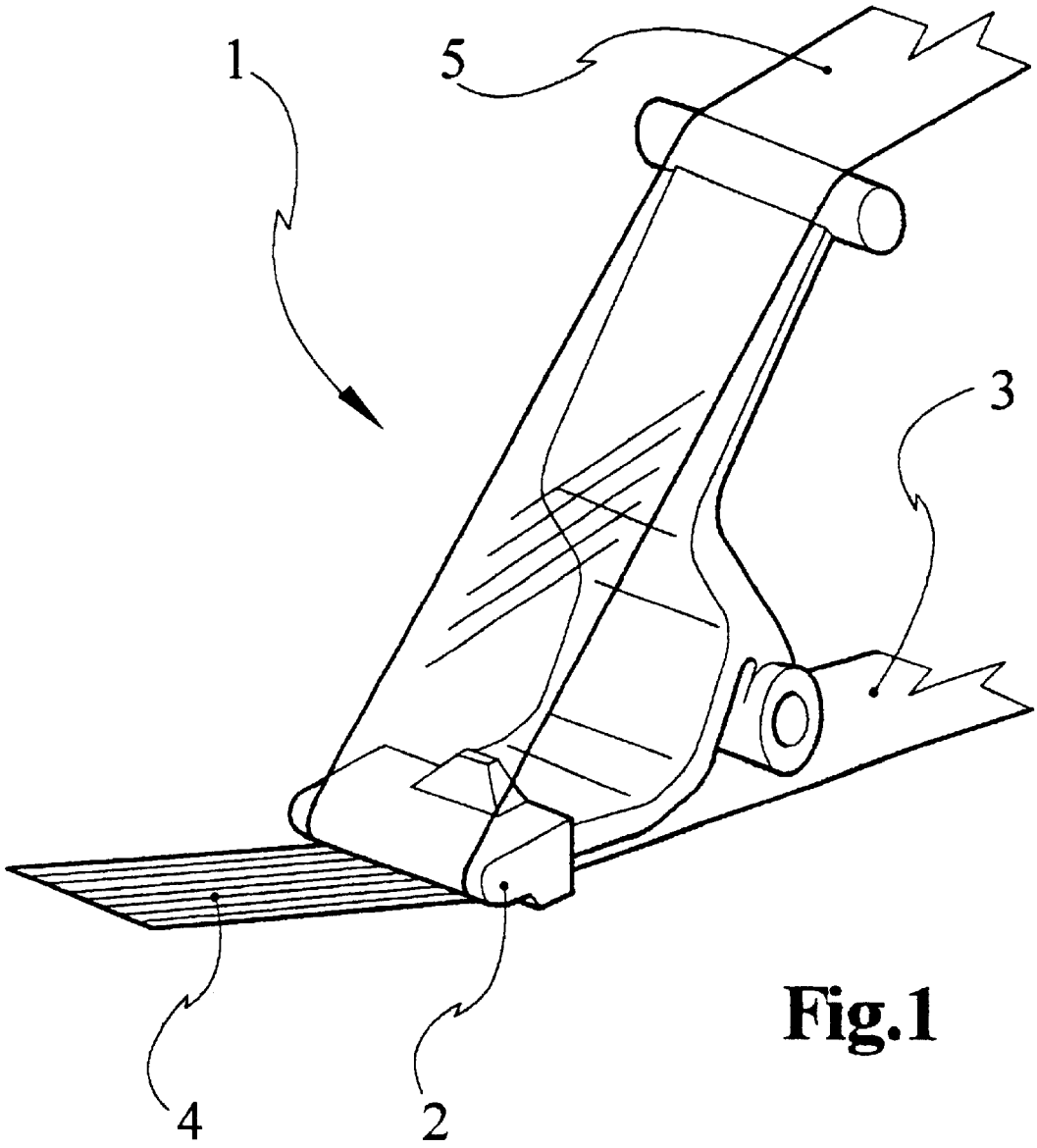

DEVICE FOR TRANSFERRING A MATERIAL IN THE FORM OF A FILM THAT IS APPLIED TO A CARRIER STRIP ONTO A SUBSTRATE

BACKGROUND OF THE INVENTION

The invention relates to a device for transferring a material in the form of a film applied to a carrier strip onto a substrate, such as a sheet of writing or drawing paper, comprising a housing in which a supply reel for the film-coated carrier strip and an empty reel for receiving the de-coated carrier strip are arranged, wherein the film-coated carrier strip is guided over an applicator foot provided at least in the region which is looped around by the carrier strip with a clip-type slide element of a friction-reducing material secured to the applicator foot.

Hand devices of that kind for transferring a film (for example, adhesive strip, concealing substance, marking ink, etc.) are known. In that case, in order to achieve a smooth motion and good capability of transfer of the film onto the substrate various embodiments for the shapes of the applicator foot are known. Thus, the applicator foot can be equipped with, for example, an applicator roller which preferably has a rubber-elastic running surface. However, as the external diameter of a functionally effective applicator roller cannot be kept as small as desired, because a good adaptation to the substrate requires a minimum thickness for the elastic running ring and the rotational mobility presupposes a sufficient difference between axle stub and external diameter, such an applicator roller has disadvantages. Accordingly, in most solutions the applicator foot usually has an applicator strip which has advantages relative to an applicator roller, as a sharper angling of the carrier strip is possible in the transfer phase, whereby the torn-off piece has less tendency to formation of a wavy edge after completion of the transfer. Thereagainst it is disadvantageous relative to the applicator roller solution that in the case of the applicator strip the carrier strip is guided thereover with a friction couple which, in dependence on the respective carrier strip quality, can lead to undesired heavygoing.

In principle, synthetic materials which have a good sliding property are known, for example polytetrafluorethylenes (PTFE), but which are higher in cost by a multiple than the standard materials usually used for the components of a device of the kind in question. Accordingly, the use of an applicator foot of polytetrafluorethylene is excluded on cost grounds.

As polytetrafluorethylene is not a true thermoplastic, a loading of the region, which is effective with respect to guidance, of the applicator foot by this high-quality material in a multi-component injection-moulding process or a subsequent injection-moulding process has to be excluded. A conceivable solution, such as gluing the applicator strip by a self-adhesive foil coated with fluoroplastics, has in fact been attempted already, but from the viewpoint of production engineering is unsuitable for mass-produced articles.

A device of the category in question is known from U.S. Pat. No. 5,430,904. In this device the applicator foot is provided in the region which is looped around by the carrier strip with a slide element made of a friction-reducing, rubber-elastic material and fastened to the applicator foot. This slide element is to improve the transfer of the film onto the substrate. In the active pressing segment of the applicator strip it has a rotationally symmetrical curved profile and as an inevitable result thereof a small linear contact region with the substrate. It has proved that on transfer of the adhesive layer onto a substrate the adhesive layer easily tears, so that the carrier strip slides over the substrate on a silicon layer and the drive is interrupted.

SUMMARY OF THE INVENTION

It is accordingly the object of the invention to so improve a device according to the category that a faultless transfer of the film onto the substrate is guaranteed in return for smallest possible outlay.

In accordance with the invention this object is met in the case of a device of the kind denoted in the introduction in that the slide element has an elliptical cross-sectional shape in such a manner that on transfer of the film onto the substrate the contact pressure region of the slide element bears over an area against the substrate with interposition of the carrier strip.

According to the invention it is possible in an unexpectedly simple manner to create, by simple change in the cross-sectional shape of the slide element, a substantially larger contact area between the slide element on the one hand and the substrate on the other hand so as to make available a sufficient contact pressure area, which ensures that the adhesive material layer does not tear off so that a faultless functioning of the device is given. The slide element itself can in this construction nevertheless be decidedly small, for example it can be produced as a semi-finished product of the smallest dimensions (for example, with an external diameter of 1 to 1.2 millimeters and 0.2 to 0.3 millimeters wall thickness), in that it is cut off to the desired length, slit in longitudinal direction and then spread apart and pushed onto the applicator foot. This can be carried out automatically in simple manner.

With particular advantage it is proposed in that case that the slide element consists of polytetrafluorethylene (PTFE) as this material has a particularly good sliding property. Obviously also materials with comparable characteristics can be used.

Moreover, it is proposed with advantage that the end portion, which receives the slide element, of the applicator foot similarly has a cross-sectional shape which is elliptical at least regionally. The slide element can then be produced in particularly simple manner as the internal profile thereof can largely correspond with the external profile. It is then, in addition, securely held at the applicator foot.

BRIEF DESCRIPTION OF THE INVENTION

Figure 2:
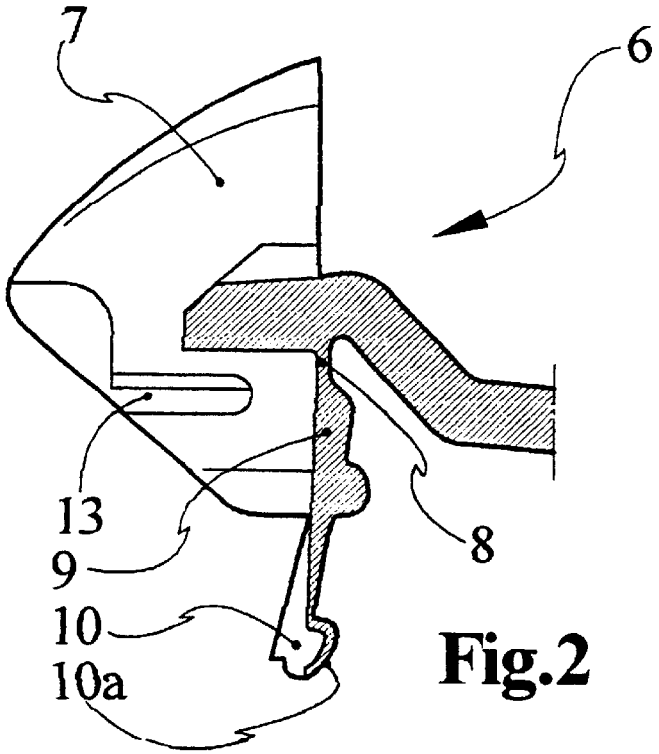
Figure 2A:
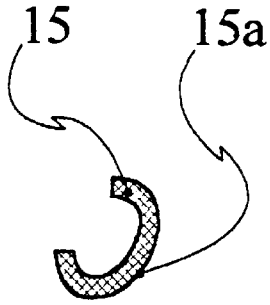
Figure 3:
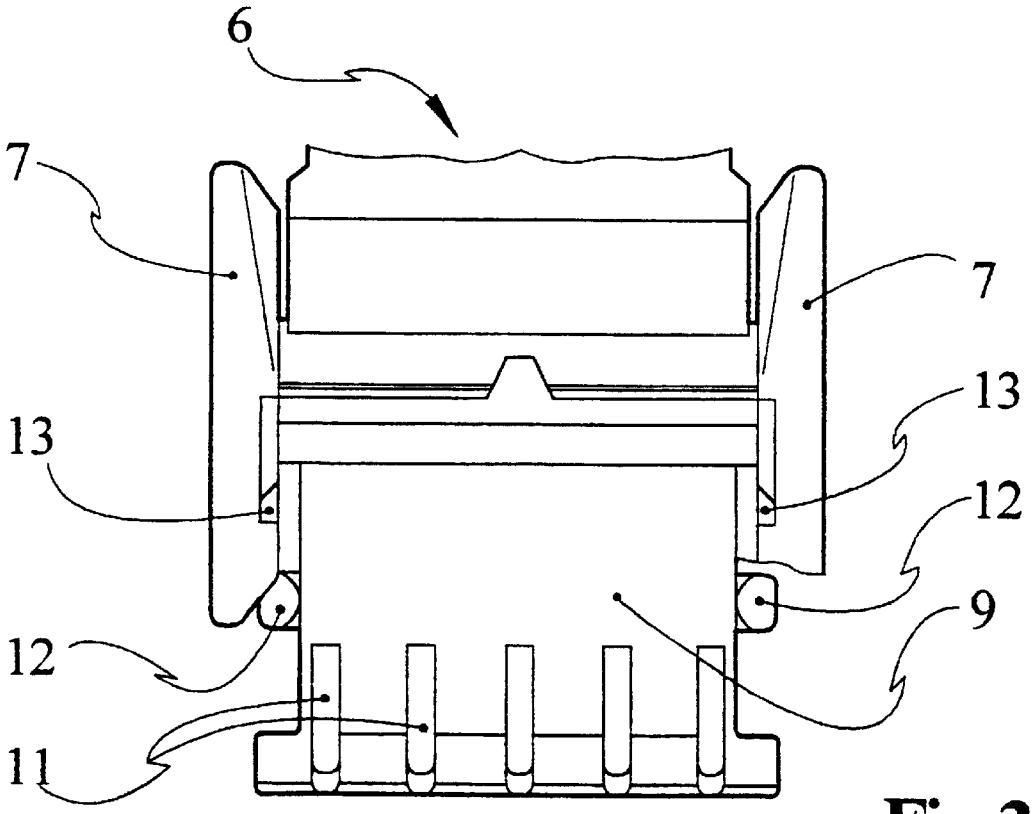
Figure 4:
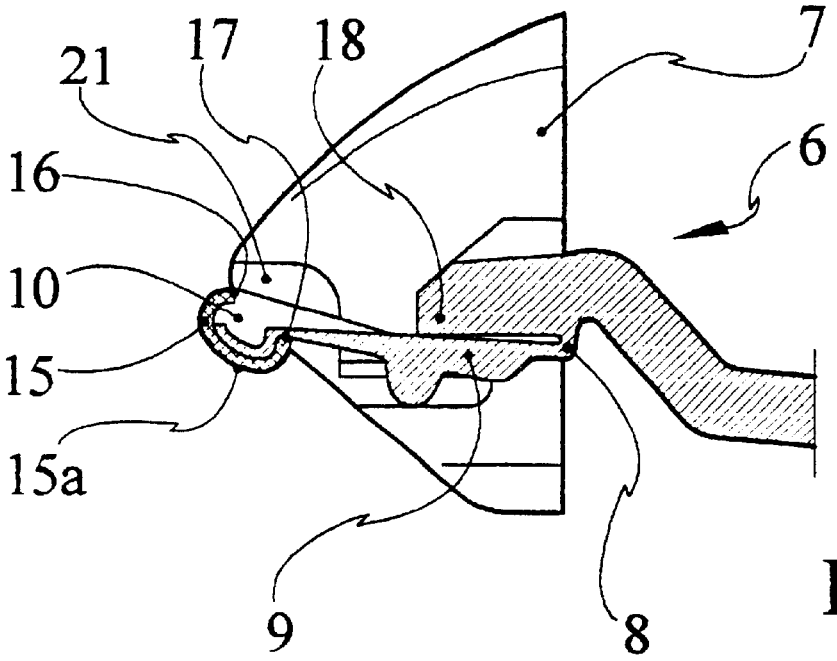
Figure 5:
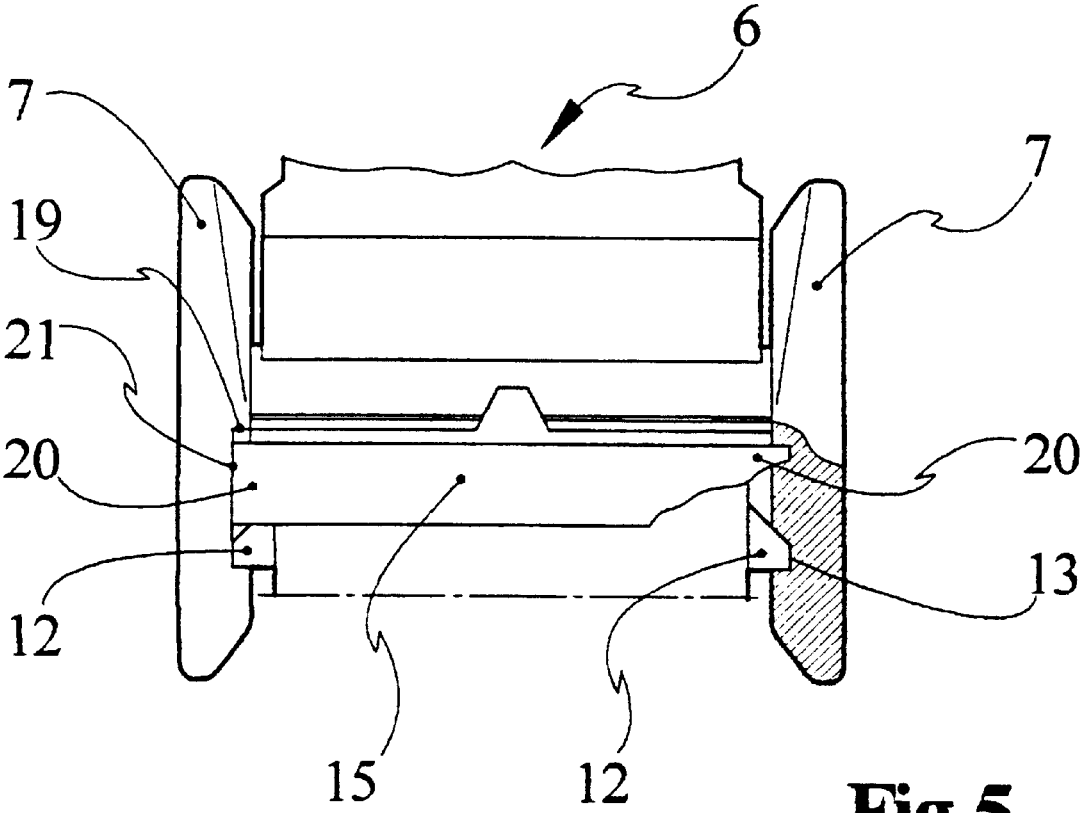
Figure 6:
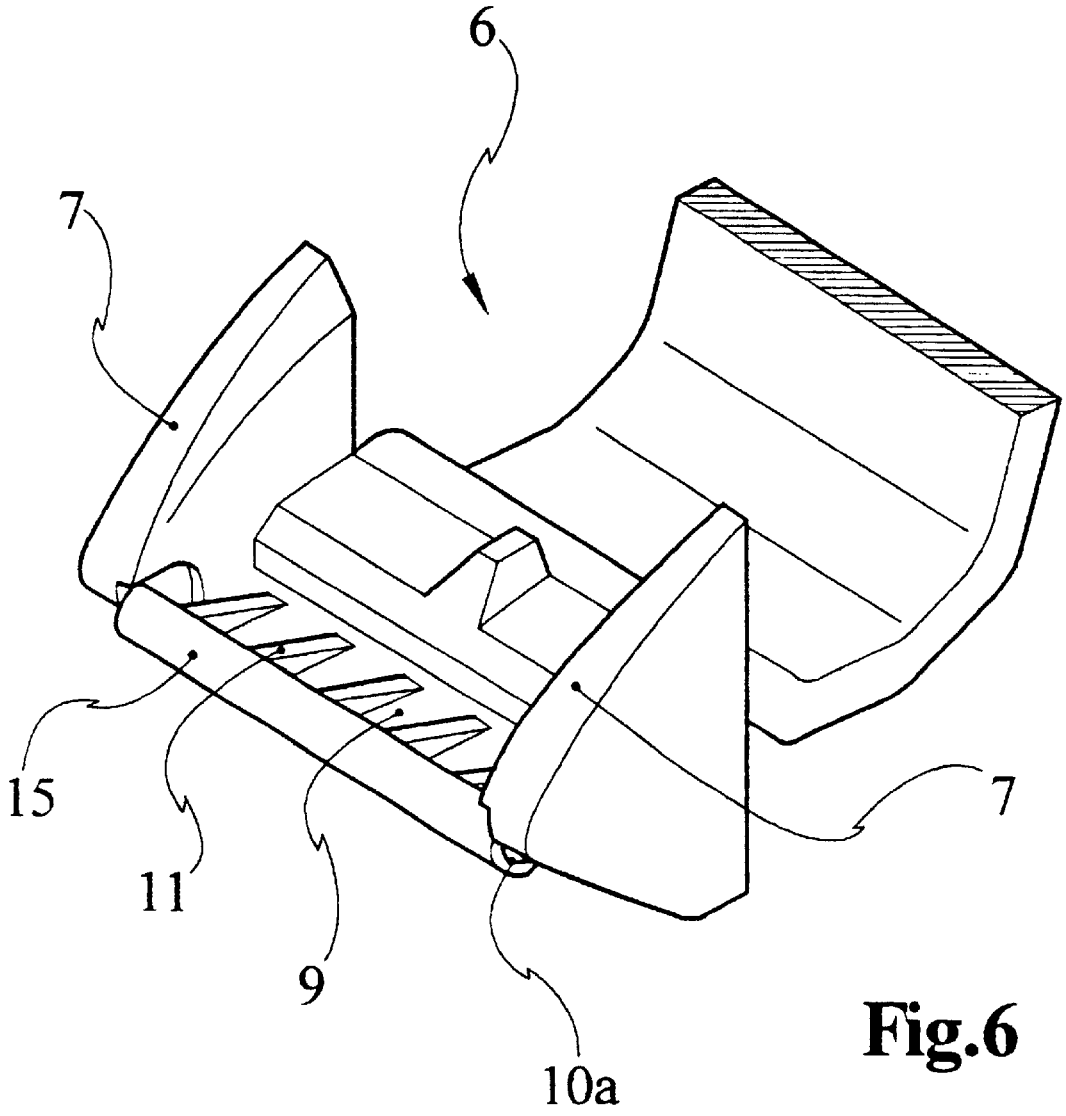

The invention is hereinafter described in more detail by way of example with reference to the drawings, in which:

FIG. 1 is a perspective illustration of an applicator foot of a device according to the state of the art, without slide element, FIG. 2 is a side view partly in section of the applicator foot of a device according to the invention, without slide element, FIG. 2*a* is a section of the slide element for the device according to FIG. 2, FIG. 3 is the front view of the applicator foot, FIG. 4 is a side view partly in section of the applicator foot according to FIG. 2, with pivoted-in extension arm and slide element in place, FIG. 5 is a front view of FIG. 4, and FIG. 6 is a perspective illustration of the applicator foot.

DETAILED DESCRIPTION

A conventional device according to the state of the art for transferring a material in the form of a film applied to a carrier strip onto a substrate is illustrated, without slide element, in FIG. 1, although only with the parts significant for the invention, namely an applicator foot which is denoted generally by 1. This applicator foot 1 is equipped with an applicator strip 2, around which a coated carrier strip 3, coming from a supply reel, which is not illustrated, of the device is guided. After the transfer of the coating 4 onto a substrate it is passed on as an empty strip 5 to a winding-up reel, which is not illustrated. It has emerged that such an applicator foot 1 is not satisfactory with respect to easy motion of the device and faultless transfer of the film onto the substrate.

According to the invention another design of the applicator foot is therefore provided, this being illustrated in FIG. 2 et seq.

An applicator foot according to the invention of a device in accordance with the invention is denoted generally by 6 in the figures. This applicator foot 6 comprises strip guide ears 7 between which the carrier strip is guided. The applicator foot 6 is provided with an extension arm 9 pivotably hinged to the applicator foot 6 by way of a film hinge 8. This extension arm 9 is formed at its end as a receiving profile member (end portion 10) for a clip-type slide element 15. Grooves 13 are cut out of the applicator foot 6 and serve the purpose of achieving a detent latching of the extension arm 9 to the applicator foot 6 in the pivoted-in position of the extension arm 9, for which purpose detent dogs 12 are provided on the extension arm 9 at both outer sides.

As evident from FIG. 3, the extension arm 9 comprises ribs 11 which are, for preference, longitudinally oriented. These ribs 11 serve, in conjunction with a selection of an elastic material, for example polyolefin, to ensure a particularly good contact between the applicator strip (end portion 10) and possible unevennesses of the substrate plane. As the clip-type slide element 15 of polytetrafluorethylene is similarly elastic, it is thereby achieved that even in the case of a non-planar substrate the entire transfer width of the strip is subjected to pressure and, similarly to an elastic roller, formation of bubbles is reliably prevented so that a smooth coating onto the substrate takes place.

Essentially to the invention the slide element 15 has, as particularly evident from FIGS. 2*a* and 4, an elliptical cross-sectional shape such that on transfer of the film to the substrate the contact pressure region 15*a* of the slide element 15 bears over an area against the substrate with interposition of the carrier strip. Moreover, it is provided that the end portion 10, which receives the slide element 15, of the applicator foot 6 or the extension arm 9 similarly has a cross-sectional shape which is elliptical in at least regionally, this region being denoted in FIG. 2 by the reference numeral 10*a*.

FIGS. 4 and 5 show the extension arm 9 in pivoted-in and locked position. In that case the film hinge 8 is pivoted through about 90° . The clip-type slide element 15 placed on the end portion 10 of the extension arm 9 is additionally fastened in the manner that abutment steps 16 and 17 are provided at the applicator foot 6 or extension arm 9, whereby the slide element 15 is secured against rotation. It is achieved through contact of the extension arm 9 with a cross-member 18 of the applicator foot 6 that the free end portion 10 of the extension arm 9 can flexibly spring out in its entirety.

The applicator foot 6 with detent dogs 12 notched in the grooves 13 and correspondingly fastened slide element 15 is recognisable in front view from FIG. 5. Through abutments 19 at the applicator foot 6 it is achieved that, in the case of possible excessive applied pressure by inappropriate handling of the device, the applicator strip formed by the slide element 15 reaches a final end abutment which is so dimensioned that the slide element 15 always protrudes by a few tenths of a millimeter beyond the profile of the strip guide ears 7, so that the transfer function is remains secured. Moreover, it is recognisable that the ends 20 of the clip-type slide element 15 are advantageously arranged to be recessed in recesses 21 of the strip guide ears 7, whereby it is ensured that the carrier strip is kept away from the ends 20 possibly compressed by the cutting to length of the tube from which the slide element 15 is preferably produced.

In FIG. 6 the entire applicator foot 6 is illustrated again in functional position, i.e. with pivoted-in and locked extension arm 9, and in particular in the end position of the clip-type slide element 15 with securing against rotation and longitudinal displacement.

The invention is obviously not restricted to the illustrated embodiments. Further refinements are possible without departing from the basic concept. The slide element 15 obviously does not have to have an exactly elliptical cross-sectional shape, it being essential that it forms an areal contact pressure region 15*a*.

What is claimed is:

1. Device for transferring a material in the form of a film applied to a carrier strip onto a substrate, such as a sheet of writing or drawing paper, comprising a housing in which a supply reel for the film-coated carrier strip and an empty reel for receiving the de-coated carrier strip are arranged, wherein the film-coated carrier strip is guided over an applicator foot provided at least in the region which is looped around by the carrier strip with a slide element of a friction-reducing material secured to the applicator foot, characterized in that the slide element has an elliptical cross-sectional shape in such a manner that on transfer of the film onto the substrate the contact pressure region of the slide element bears over an area against the substrate with interposition of the carrier strip, the elliptical cross-sectional shape including a large diameter surface between two small diameter surfaces, and the large diameter surface being outermost of the applicator foot.

2. Device according to claim 1, characterized in that the slide element consists of polytetrafluoroethylene (PTFE).

3. Device according to claim 2, characterized in that the end portion, which receives the slide element, of the applicator foot similarly has a cross-sectional shape which is elliptical at least regionally.

4. Device according to claim 3, characterized in that the applicator foot includes abutment steps mounted for securing the slide element against rotation.

5. Device according to claim 2, characterized in that the applicator foot includes abutment steps mounted for securing the slide element against rotation.

6. Device according to claim 1, characterized in that the applicator foot includes abutment steps mounted for securing the slide element against rotation.

7. Device according to claim 1, characterized in that the end portion, which receives the slide element, of the applicator foot similarly has a cross-sectional shape which is elliptical at least regionally.

* * * * *

UNITED STATES PATENT AND TRADEMARK OFFICE

CERTIFICATE OF CORRECTION

PATENT NO. : 6,629,552 B1
DATED : October 7, 2003
INVENTOR(S) : Herrmannsen et al.

It is certified that error appears in the above-identified patent and that said Letters Patent is hereby corrected as shown below:

Title page,
Item [73], Assignee, delete "Produktionsgesellschft", and insert therefore
-- Produktionsgesellschaft --.

Signed and Sealed this

Twelfth Day of April, 2005

JON W. DUDAS
*Director of the United States Patent and Trademark Office*